US006029419A

United States Patent [19]

Kimura

[11] Patent Number: 6,029,419

[45] Date of Patent: Feb. 29, 2000

[54] STRUCTURAL LAMINATED WOOD AND CONSTRUCTION MEMBERS FOR FRAMEWORK STRUCTURES OF BUILDINGS

[76] Inventor: Kazuyoshi Kimura, No. 5-12, Matsuei 1-chome, Yamagata-shi, Yamadata-ken, Japan

[21] Appl. No.: 09/047,998

[22] Filed: Mar. 26, 1998

[30] Foreign Application Priority Data

Mar. 27, 1997 [JP] Japan ..... 9-75707

[51] Int. Cl.[7] ..... E04C 2/00

[52] U.S. Cl. ..... 52/796.1; 52/731.7; 52/730.7; 428/106

[58] Field of Search ..... 52/796.1, 730.6, 52/731.7, 729.4, 730.7; 428/537.1, 106, 107

[56] References Cited

U.S. PATENT DOCUMENTS

| | | | |
|---|---|---|---|
| 1,197,739 | 9/1916 | Hutchins | 52/731.7 |
| 1,377,891 | 5/1921 | Knight | 52/729.4 X |
| 1,921,164 | 8/1933 | Lewis | 428/106 |
| 2,230,628 | 2/1941 | Sahlberg | 52/731.7 X |
| 2,391,049 | 12/1945 | Weiller | 52/729.4 |
| 4,387,546 | 6/1983 | Kurita et al. | 52/730.7 |
| 4,535,019 | 8/1985 | Coronado | 428/106 |
| 4,784,887 | 11/1988 | Abendroth | 428/537.1 X |
| 5,439,749 | 8/1995 | Klasell et al. | 428/106 X |
| 5,720,143 | 2/1998 | Soltis et al. | 52/730.7 |
| 5,881,529 | 3/1999 | Rudd | 52/730.7 X |

FOREIGN PATENT DOCUMENTS

| | | | |
|---|---|---|---|
| 000624855 | 1/1936 | Germany | 52/729.4 |

*Primary Examiner*—Carl D. Friedman
*Assistant Examiner*—Brian E. Glessner
*Attorney, Agent, or Firm*—Laubscher & Laubscher

[57] ABSTRACT

With a structural laminated wood (L.V.L) made up by laminating and bonding a plurality of wood laminas, the wood laminas are respectively formed in an approximate L-shape or U-shape in one plane, and the structural laminated wood is formed in an approximate L-shape or U-shape having two side portions of predetermined lengths approximately at right angles to each other. Moreover, with a construction member for a framework structure for buildings, where the construction member uses the structural laminated wood, one side portion of the structural laminated wood is made at least a part of a vertical construction member, and the other side portion is made at least a part of a transverse construction member.

1 Claim, 8 Drawing Sheets

PRIOR ART

PRIOR ART

STRUCTURAL LAMINATED WOOD AND CONSTRUCTION MEMBERS FOR FRAMEWORK STRUCTURES OF BUILDINGS

BACKGROUND OF THE INVENTION

1. Field of the Invention

The present invention relates to structural laminated wood and construction members for framework structures of buildings utilizing the structural laminated wood.

2. Description of the Related Art

From the results of dedicated research carried out over many years, the present inventor has developed a joint apparatus for construction members which is simpler than the simplest conventional coupling methods, for example methods involving various combinations of iron plates and bolts and nuts, and strengthwise is superior to the time honoured wooden cut out method.

This will be apparent from the disclosure of Japanese Examined Patent Publication No. 6-57977.

With this joint apparatus, standardised pre-cut members can be used for the construction members. This joint apparatus is the one for construction members comprising suitable standardized joint members which makes it possible to couple the standardized pre-cut members to form the framework of a building. This apparatus can thus construct frameworks applicable to buildings and the like, which combine both the features of the customary framing method and built-up wall method.

In constructing such a building, structural laminated wood L.V.L (laminated veneer lumber) is used for the construction members making up the framework structure.

Structural laminated wood is formed for example by thinly slicing a log by a rotary lathe, after which thin sheets (wood laminas) formed by cutting are dried, and a plurality of the thin sheets then bonded together using adhesive. Compared to normal laminated wood, this has a high allowable strength and waterproof.

This type of structural laminated wood is used as vertical construction members for example columns, and as transverse construction members for example beams.

However, since conventional structural laminated wood for columns (referred to hereunder as laminated columns) and structural laminated wood for beams (referred to hereunder as laminated beams) is formed in various simple rectangular shapes, there are the following problems.

That is to say, with the corner portions of a framework structure as shown in FIG. 7, a laminated column 1 and a laminated beam 2 are joined by jointing devices 3 (bolts and nuts; drift pins).

In this case, since the joint portion between the laminated column 1 and the laminated beam 2 is subjected to a moment due to transverse forces, it is necessary to have a rigid joint portion construction resisting the moment. For example as shown in FIG. 7, the location of the jointing devices 3 must be positioned on a circle or the like. Hence the jointing operation takes time.

In general with buildings, the construction is such that the transverse forces applied to the building due for example to earthquakes or strong winds is resisted by the wall structure and bracing.

For example as shown in FIG. 8 and FIG. 9, it is possible to make up a bearing structure such as a wall structure and bracing for the open portion of a room.

However, when making for example a parking area on the first floor area of a building, if the transverse width of the building is narrow, it is all to maintain the width of the entrance to the parking area. Hence it is not possible to have a bearing structure formed by a wall structure and bracing, on the opposite sides of the entrance.

Therefore, the first floor area of the building will not be resistant to transverse forces applied to the building due to earthquakes, strong winds or the like, resulting in a framework structure of poor strength.

SUMMARY OF THE INVENTION

The present invention addresses the abovementioned problems, with the object of providing a structural laminated wood which can obviate the joint between the structural laminated wood of the vertical and transverse construction members at the corner portions of a framework structure in a building.

In order to achieve the above object, the present invention provides a structural laminated wood for buildings, the structural laminated wood being made up by laminating and bonding a plurality of thin sheets of wood, wherein the thin sheets are respectively formed in an approximate L-shape in one plane, and the structural laminated wood is formed in an approximate L-shape having two side portions of predetermined lengths approximately at right angles to each other.

In this way, since the corner portions of the framework structure can be formed by a single structural laminated wood, it is no longer necessary as with the conventional arrangement, to join the laminated wood columns and beams with a jointing device (bolt and nut; drift pin). Hence the troublesome jointing operation is avoided, improving the workability.

Alternatively, the present invention provides a structural laminated wood for buildings, the structural laminated wood being made up by laminating and bonding a plurality of thin sheets of wood, wherein the thin sheets are respectively formed in approximate U-shapes in one plane, and the structural laminated wood is formed in an approximate U-shape having two side portions of predetermined lengths each approximately at right angles to one side portion of a predetermined length.

In this way, since the two corner portions of the framework structure can be formed by a single structural laminated wood, it is no longer necessary as with the conventional arrangement, to join the laminated wood pairs.

Furthermore, it is an object of the present invention to provide a construction member for a framework structure which uses the abovementioned structural laminated wood, and which can give a strengthwise robust framework structure while obviating the bearing structure achieved by a wall structure and bracing.

In order to achieve the above object, the present invention provides a construction member for a framework structure for buildings, the construction member using the abovementioned structural laminated wood, wherein one side portion of the structural laminated wood is made at least a part of a vertical construction member, and the other side portion is made at least a part of a transverse construction member.

In this way, when making for example a parking area on a first floor area of a building, then even when in the case where the transverse width of the building is narrow so that it is all to maintain the width of the entrance to the parking area, then even if a bearing structure formed by a wall structure and bracing, on the opposite sides of the entrance is not provided, then by means of the construction member using a structural laminated wood of approximate L-shape or U-shape, the transverse force applied to the building due for example to earthquakes or strong winds, can be adequately resisted so that a strengthwise robust framework structure can be achieved.

In this case, the constitution may be such that a pair of the beforementioned structural laminated woods are provided, and corresponding side portions of the two structural laminated woods, which each constitute at least one part of a transverse construction member are connected by a connecting device.

In this way, by providing the pair of structural laminated woods and connecting the corresponding side portions of the two structural laminated woods, which each make up at least one part of a transverse construction member, then the structural laminated wood pairs can be easily connected.

In particular, the constitution may be such that the connecting device includes a metal connecting plate member, and a fastener for fastening opposite end portions of the metal connecting plate member to the end portions of the side portions of the structural laminated woods, with the opposite end portions of the metal connecting plate member respectively inserted into grooves formed in the end portions of the side portions of the structural laminated woods.

Alternatively, the constitution may be such that a pair of the structural laminated woods are provided, and corresponding side portions of the two structural laminated woods, which each constitute at least one part of a transverse construction member are connected by at least one approximately I-shape structural laminated wood constituting a transverse construction member.

In this way, by using an approximate I-shape structural laminated wood, then a transverse construction member comprising structural laminated woods, corresponding to a predetermined length span can be easily made.

In this case, the constitution may be such that connecting devices are provided for connecting the pair of structural laminated woods to the approximate I-shape structural laminated wood, and the connecting devices include a metal connecting plate member, and a fastener for fastening opposite end portions of the metal connecting plate member to end portion side faces of the side portions of the structural laminated woods and to end portion side faces of the approximate I-shape structural laminated wood, with the opposite end portions of the metal connecting plate member respectively engaged with the end portion side face of the side portion of the structural laminated wood and the end portion side face of the approximate I-shape structural laminated wood.

In this way, the approximate L-shape structural laminated wood and the approximate I-shape structural laminated wood can be easily connected by the connecting device.

Alternatively, the constitution may be such that a plurality of I-shape structural laminated woods are provided and connecting devices are provided for connecting adjacent approximate I-shape structural laminated woods to each other, and the connecting devices include a metal connecting plate member, and a fastener for fastening opposite ends of the metal connecting plate member to the respective opposite end side faces of the structural laminated wood, with the opposite end portions of the metal connecting plate member each engaged with end side faces of the respective structural laminated woods.

In this way, the approximate I-shape structural laminated wood pairs can be easily connected with a connecting device.

Furthermore, in order to achieve the above object, the present invention provides a construction member for a framework structure for buildings, the construction member using the abovementioned structural laminated wood for buildings, wherein two side portions of the structural laminated wood are made at least one part of the vertical construction member, and one side portion is made the transverse construction member.

In this way, when making for example a parking area on a first floor area of a building, then even when in the case where the transverse width of the building is narrow so that it is all to maintain the width of the entrance to the parking area, then even if a bearing structure formed by a wall structure and bracing, on the opposite sides of the entrance is not provided, then by means of the construction member using a structural laminated wood of approximate L-shape or U-shape, the transverse force applied to the building due for example to earthquakes or strong winds, can be adequately resisted so that a strengthwise robust framework structure can be achieved.

As follows is a detailed description of the present invention based on embodiments shown in the drawings. From this, the present invention can be better understood. However, the present invention is not limited to these embodiments and can be freely modified within the scope of the claims.

DESCRIPTION OF THE PREFERRED EMBODIMENTS

As follows is a description of embodiments of the present invention with reference to the drawings.

Figure 1:
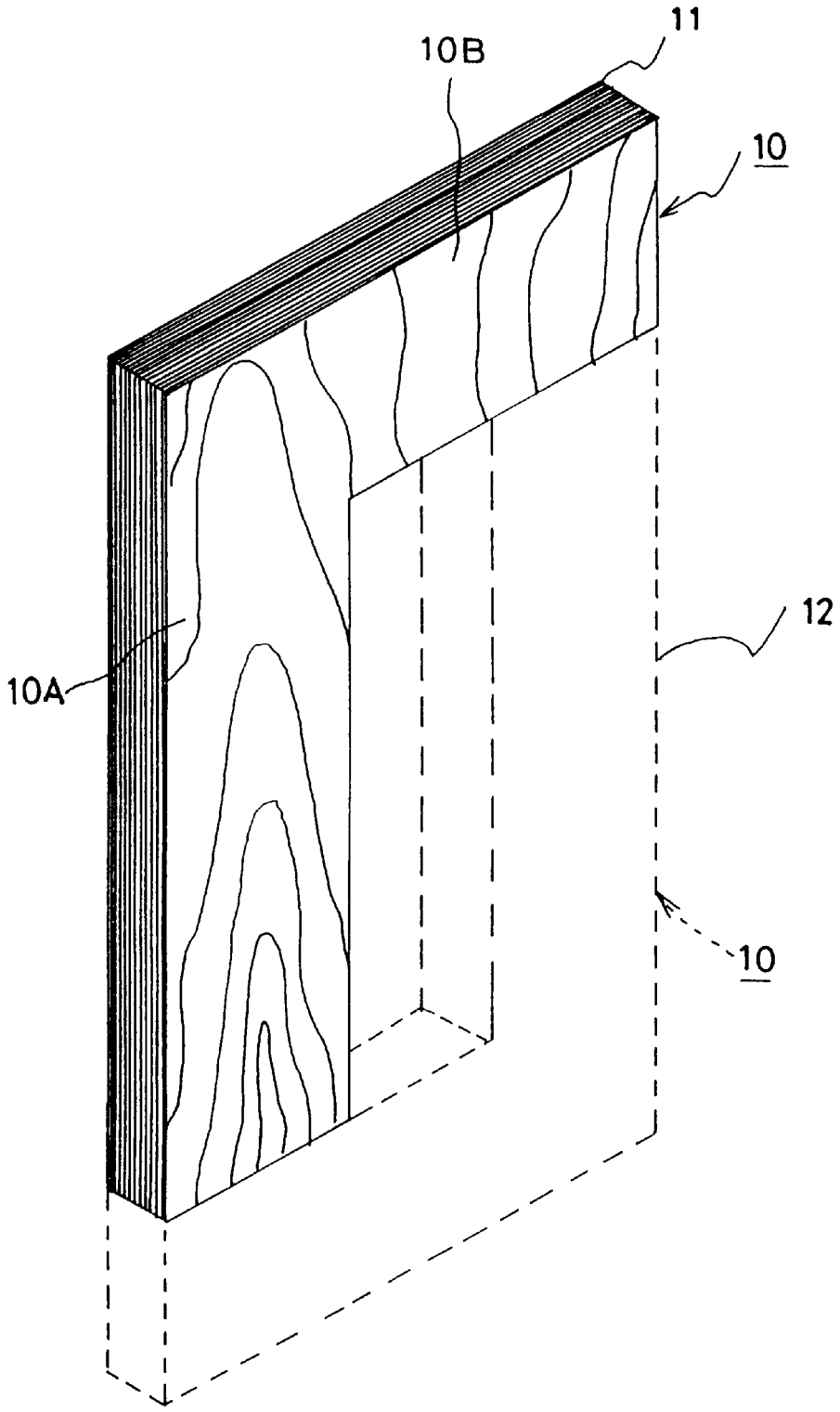
FIG. 1 is a perspective view illustrating an embodiment of a structural laminated wood according to the present invention.

FIG. 1 shows the structure of an embodiment of a structural laminated wood for a building according to the present invention.

In FIG. 1, a structural laminated wood (referred to hereunder as L.V.L) 10 is made up by laminating and bonding a plurality of thin sheets of wood (referred to hereunder as wood laminates) 11.

Each wood lamina 11 is respectively formed in an approximate L-shape in one plane, and the L.V.L. 10 is formed in an approximate L-shape having two side portions of predetermined lengths approximately at right angles to each other.

In this case, as shown in the figure, the two parts on the diagonal of a single rectangular shape L.V.L 12 formed by laminating and bonding wood laminas which are cut off in rectangular shapes, are cut into respective approximate L-shapes to obtain two approximate L-shape L.V.Ls 10.

When this approximate L-shape L.V.L 10 is used as a construction member for a framework structure, then one side portion 10A of the L.V.L 10 becomes at least one part of a vertical construction member and the other side portion 10B becomes a least one part of a transverse construction member.

Figure 2:
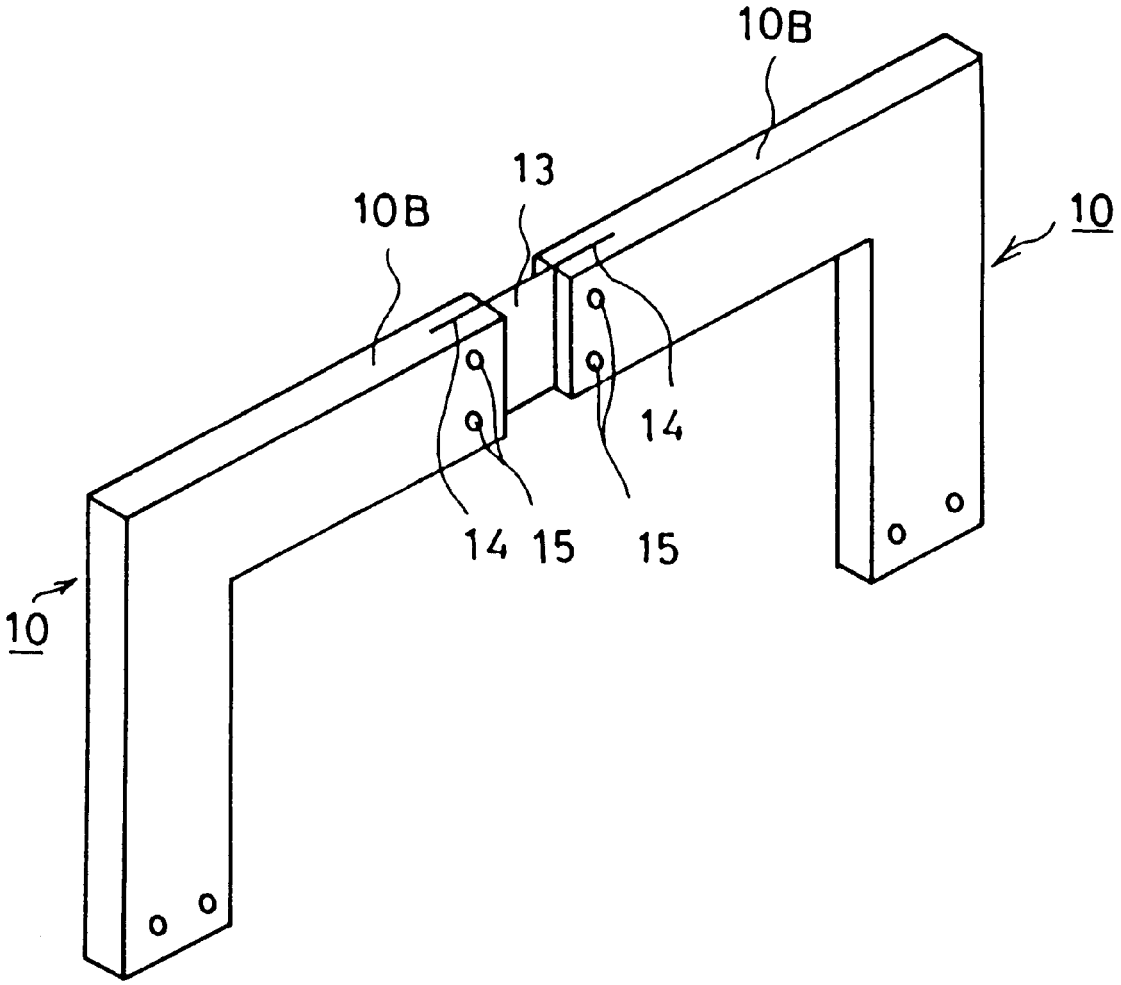
FIG. 2 is a perspective view showing an embodiment of a construction member made from the abovementioned structural laminated wood.

FIG. 2 shows an embodiment of this construction member. A construction member is shown made up of a pair of L.V.Ls 10 with columns, being the left and right pair of vertical construction members, and a beam being a single transverse construction member connected to these columns.

That is to say, the construction member is made up by connecting the respective side portions 10B of the pair of L.V.Ls 10 using a connecting device.

In this case the connecting device comprises a metal connecting plate member 13, and a fastener (bolt and nut; drift pin etc.) 15 for fastening opposite end portions of the metal connecting plate member 13 to the end portions of the side portions 10B of the L.V.Ls 10, with the opposite end portions of the metal connecting plate member 13 respectively inserted into grooves 14 formed in the end portions of the side portions 10B of the L.V.Ls 10.

Figure 3:
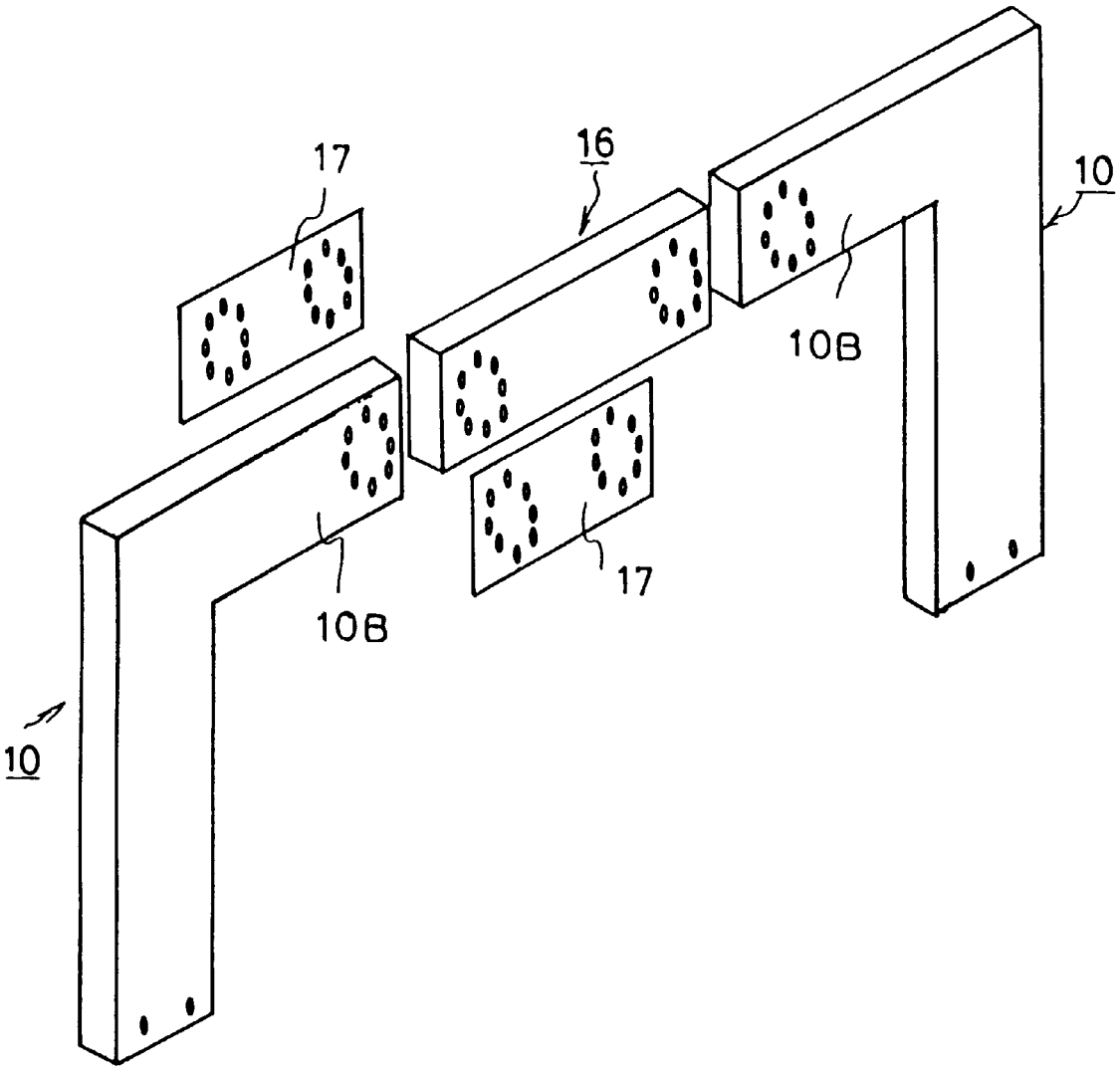
FIG. 3 is a perspective view showing another embodiment of a construction member made from the abovementioned structural laminated wood.

FIG. 3 shows another embodiment of a construction member. A pair of L.V.Ls 10 are provided and respective corresponding side portions 10B of the two L.V.Ls 10, are connected by one approximate I-shape L.V.L 16 constituting a beam.

In this case, a connecting device is provided for connecting the pair of L.V.Ls 10 to the approximate I-shape L.V.L 16.

This connecting device comprises a metal connecting plate member 17, and a fastener (bolt and nut; drift pin etc.) for fastening opposite end portions of the metal connecting plate member 17 to the end portion side faces of the side portions 10B of the L.V.Ls 10 and to the end portion side faces of the approximate I-shape L.V.L 16, with the opposite end portions of the metal connecting plate member 17 respectively engaged with the end portion side face of the side portions 10B of the L.V.Ls 10 and the end portion side face of the approximate I-shape L.V.L 16.

With the respective connecting portions of the L.V.Ls 10 and the L.V.L 16, as shown in the figure the location of the joint device is arranged in a circle.

Figure 4:
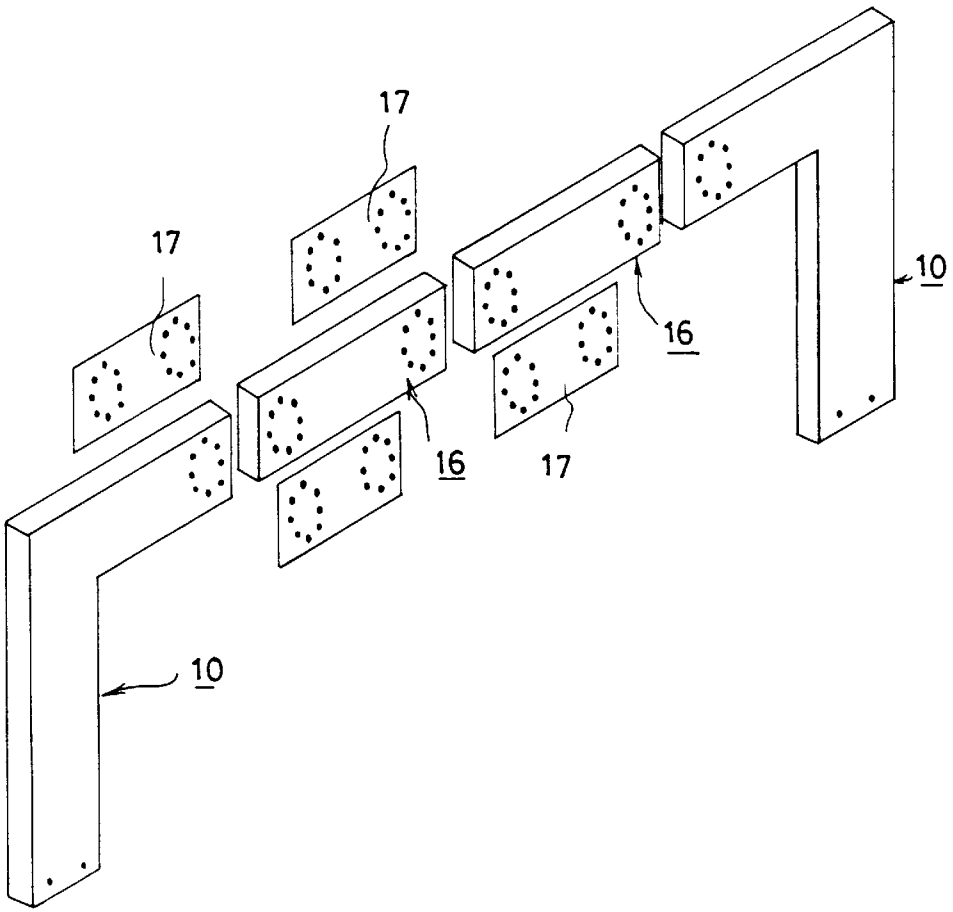
FIG. 4 is a perspective view showing yet another embodiment of a construction member made from the abovementioned structural laminated wood.

With this embodiment, a pair of L.V.Ls 10 are connected by a single approximate I-shape L.V.L 16. However as shown in FIG. 4, the construction may be such that these are connected by a plurality (for example two) approximate I-shape L.V.Ls 17.

In this case, the respective approximate I-shape L.V.Ls 16 may be connected by a connecting device comprising a metal connecting plate member 17 and a fastener similar to as shown in FIG. 3.

Now, the L.V.Ls 10 and the other construction members in the framework structure may be connected by a joint member for construction member as illustrated by Japanese Examined Patent Publication No. 6-57977, that is by a U-connector.

With the L.V.Ls 10 of these constitutions, since the corner portions of the framework structure can be formed by a single L.V.L, it is no longer necessary as with the conventional arrangement, to join the laminated wood columns and beams with a jointing device (bolt and nut; drift pin). Hence the troublesome jointing operation is avoided, improving the workability.

Figure 5:
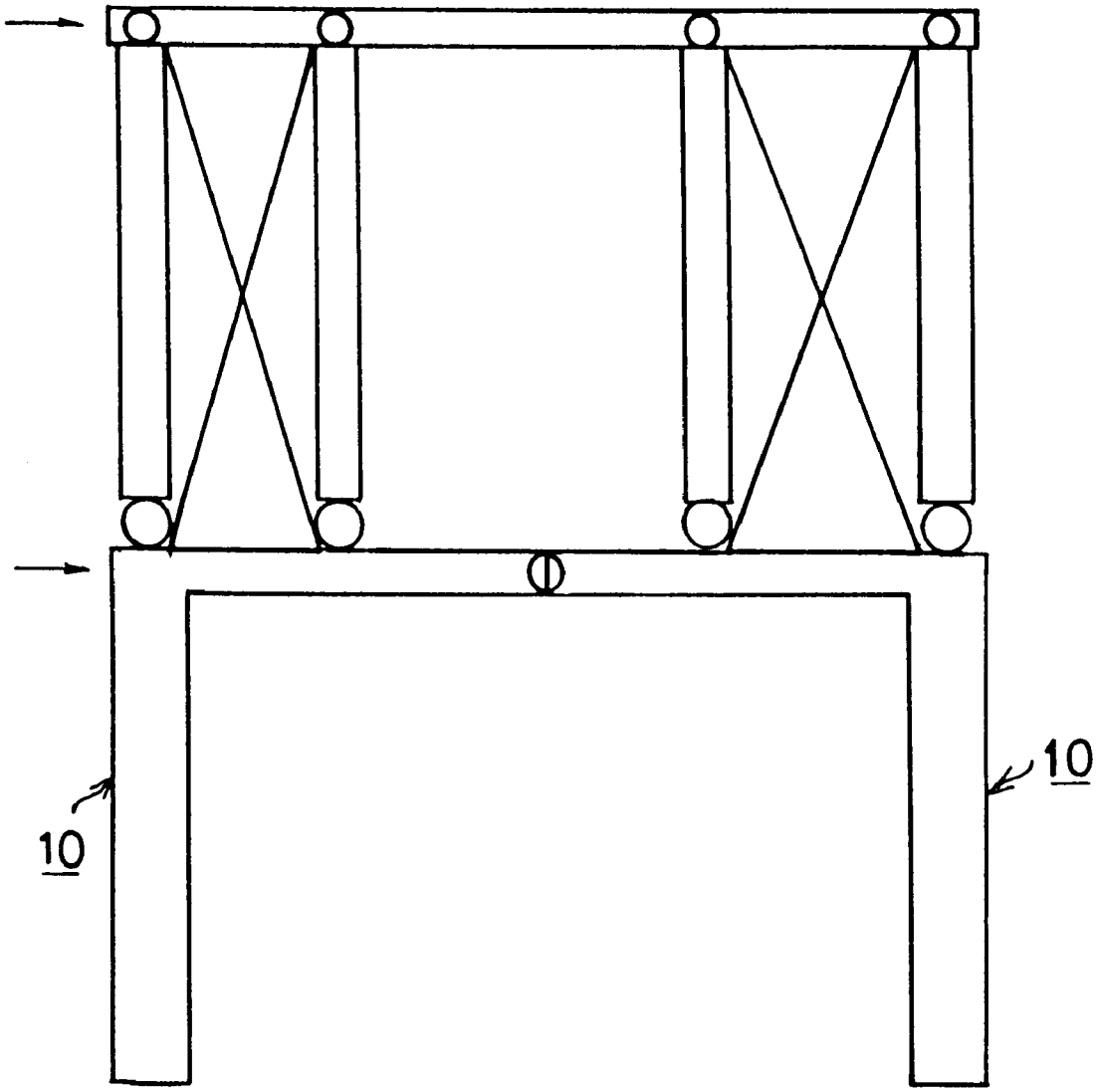
FIG. 5 is a schematic diagram showing a framework structure which uses the abovementioned construction member.

Furthermore, with the construction member of this constitution, when making for example a parking area on a first floor area of a building, then even when in the case where the transverse width of the building is narrow so that it is all to maintain the width of the entrance to the parking area, then even if a bearing structure formed by a wall structure and bracing, on the opposite sides of the entrance is not provided, then by means of the construction member using approximate L-shape L.V.Ls 10, the transverse force applied to the building due for example to earthquakes or strong winds, can be adequately resisted so that a strengthwise robust framework structure can be achieved (refer to FIG. 5).

Figure 6:
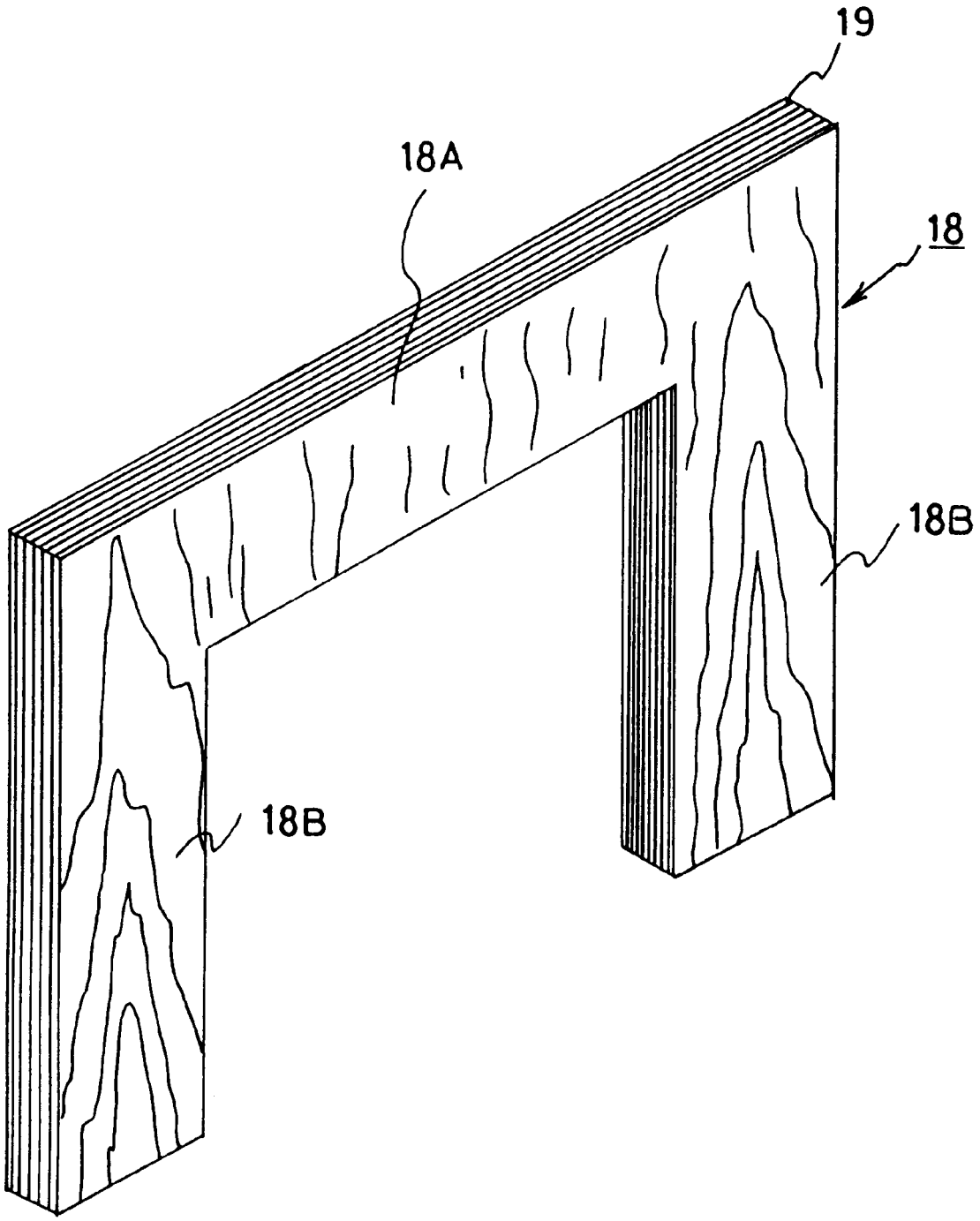
FIG. 6 is a perspective view illustrating another embodiment of a structural laminated wood of the present invention.
Figure 7:
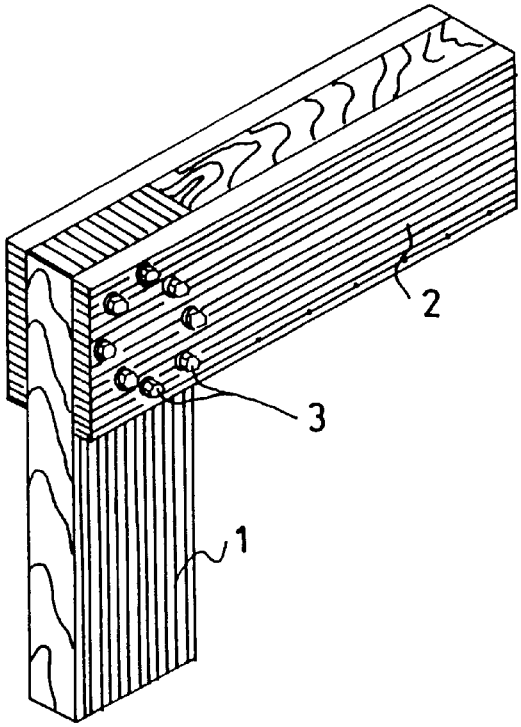
FIG.7 PRIOR ART
FIG. 7 is a perspective view showing a corner portion made by a conventional structural laminated wood.
Figure 8:
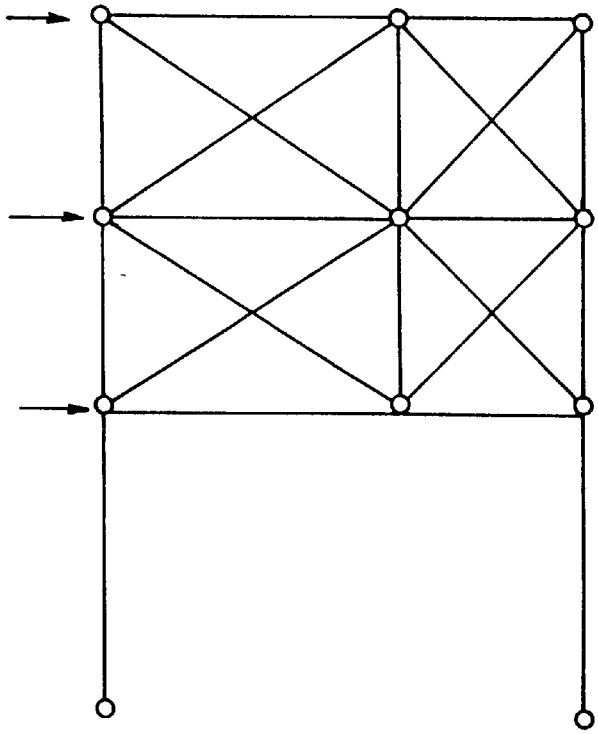
FIG. 8 is a schematic diagram showing a framework structure using conventional construction members.
Figure 9:
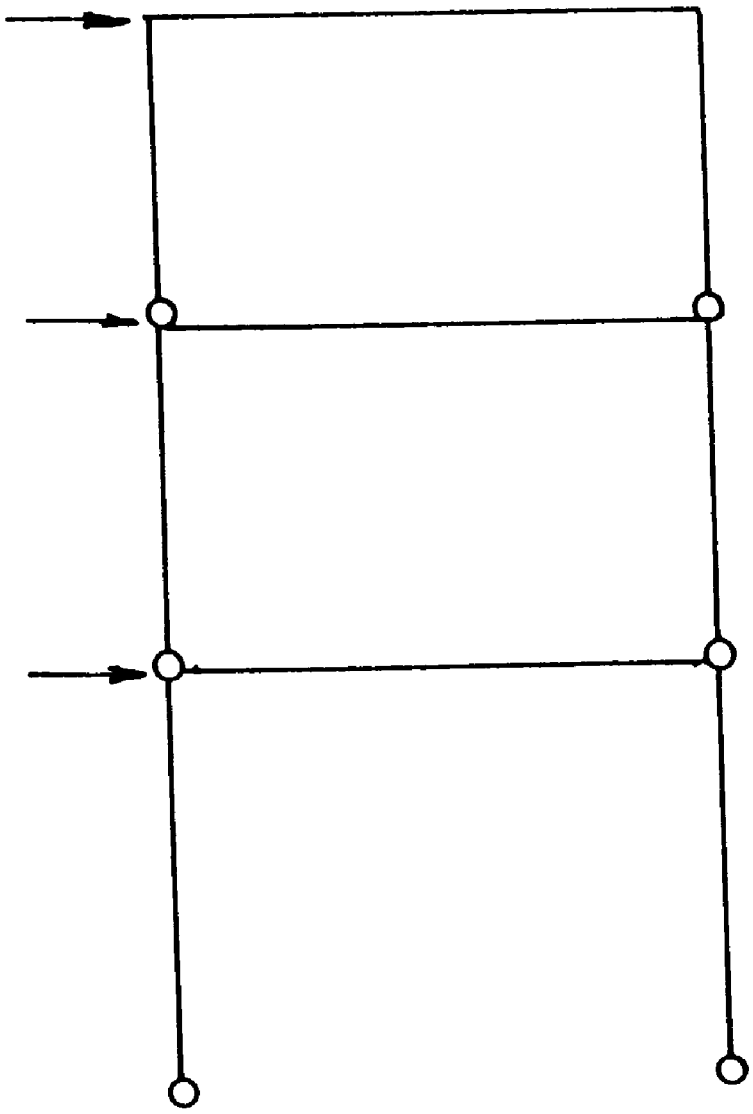
FIG. 9 is another schematic diagram showing a framework structure using conventional construction members.

FIG. 6 shows another embodiment of an L.V.L for a building.

With the L.V.L 18 of this embodiment, wood laminas 19 are respectively formed in approximate U-shapes in one plane, to form the L.V.L 18 in an approximate U-shape having two side portions 18B of predetermined lengths each approximately at right angles to one side portion 18A of a predetermined length.

When this U-shape L.V.L 18 is used as a construction member of a framework structure, the two sides 18B become two columns, while the one side 18A becomes a beam.

With the L.V.L 18 of this constitution, there is the advantage that the two corner portions of a framework structure can be formed from a single L.V.L, thus obviating connection of the L.V.L members.

What is claimed is:

1. A construction member for the framework of a building, comprising (a) a pair of structural members formed from a plurality of laminated and bonded thin, unitary sheets of wood each of said sheets having a planar L-shape configuration, each of said structural members being formed in an L-shape configuration having two side portions of predetermined lengths arranged at right angles, one side portion of each of said structural members forming at least a portion of a vertical construction member and another side portion of each of said structural members containing a groove at the end and forming at least a portion of a transverse construction member, respectively; and (b) connecting means including a metal plate having opposite ends arranged in said grooves, respectively, and fasteners for connecting each end of said plate with a respective end of transverse portions of said structural members, and connecting said transverse portions to define a U-shaped construction member.

* * * * *